US009913541B2

(12) United States Patent
Arnett

(10) Patent No.: US 9,913,541 B2
(45) Date of Patent: Mar. 13, 2018

(54) ADJUSTABLE SEATING ASSEMBLY

(71) Applicant: Michael Arnett, Plantation, FL (US)

(72) Inventor: Michael Arnett, Plantation, FL (US)

( * ) Notice: Subject to any disclaimer, the term of this patent is extended or adjusted under 35 U.S.C. 154(b) by 201 days.

(21) Appl. No.: 14/959,742

(22) Filed: Dec. 4, 2015

(65) Prior Publication Data

US 2016/0157618 A1 Jun. 9, 2016

Related U.S. Application Data

(60) Provisional application No. 62/087,652, filed on Dec. 4, 2014.

(51) Int. Cl.

| | |
|---|---|
| ***A47C 9/00*** | (2006.01) |
| ***A47C 7/54*** | (2006.01) |
| ***A47B 39/02*** | (2006.01) |

(52) U.S. Cl.

CPC ..... *A47C 7/54* (2013.01); *A47B 39/02* (2013.01); *A47C 9/002* (2013.01); *A47C 9/005* (2013.01)

(58) Field of Classification Search

CPC ..... A47C 9/005; A47C 9/002; A47C 7/54; A47B 39/02

USPC ..... 297/423.11, 344.11, 195.11, 174 R, 327

See application file for complete search history.

(56) References Cited

U.S. PATENT DOCUMENTS

| | | | | |
|---|---|---|---|---|
| 5,295,728 | A | 3/1994 | Schaevitz | |
| 5,330,248 | A * | 7/1994 | Smyly | A47B 27/02 248/460 |
| 5,487,590 | A | 1/1996 | Haynes | |
| 5,720,517 | A * | 2/1998 | Prothro, Sr. | A47C 7/503 297/19 |
| 6,065,808 | A | 5/2000 | Tinsley | |
| 6,595,589 | B2 | 7/2003 | Cochran | |
| 6,698,831 | B2 | 3/2004 | Lloyd | |
| 6,729,690 | B2 | 5/2004 | Roleder et al. | |
| 8,702,162 | B2 | 4/2014 | Isaacson | |
| 2007/0052275 | A1* | 3/2007 | Ghilzai | A47C 1/06 297/423.12 |
| 2015/0189992 | A1* | 7/2015 | Richardson | A47C 15/004 297/195.11 |

FOREIGN PATENT DOCUMENTS

WO WO008606940 A1 * 12/1986

* cited by examiner

*Primary Examiner* — Milton Nelson, Jr.

(74) *Attorney, Agent, or Firm* — Johnson | Dalal; Mark C. Johnson

(57) ABSTRACT

An adjustable seating assembly is disclosed having a base with a first end, a second end opposite the first end, and a length extending from the first end to the second end. A frame assembly has a pair of support legs coupled to the base along the length. A seating-support surface is disposed above the base and coupled to the frame assembly. A chest-support surface is disposed above the base and coupled to the frame assembly and the chest-support surface is orientated at an acute angle with respect to the seating-support surface. The pair of the support legs are selectively translatable along the length of the base in a first direction and a second direction opposite the first direction so as to selectively rotate the chest-support surface and the seating-support surface simultaneously while maintaining the acute angle between the chest-support surface and the seating-support surface during the rotation.

18 Claims, 8 Drawing Sheets

100

100

ADJUSTABLE SEATING ASSEMBLY

CROSS-REFERENCE TO RELATED APPLICATION

This application claims priority to U.S. Provisional Patent Application No. 62/087,652 filed Dec. 4, 2014, the entirety of which is incorporated by reference.

FIELD OF THE INVENTION

The present invention relates generally to ergonomic chairs suitable for home or office use, and, more particularly, relates to an adjustable seating assembly that provides multiple seating positions for a user that relieves back and other body pain experience by the user.

BACKGROUND OF THE INVENTION

Adjustable chairs are known in various therapeutic settings. However, such chairs are configured for use by a primary user intended to receive therapy, as well as, use by a secondary user intended to provide said therapy to the primary user. Accordingly, adjustment features and controls are often positioned so as to provide access to the secondary user who is in control of positioning the primary user. In addition, such chairs are not designed specifically to provide ergonomic benefits to the primary user that addresses prolonged use by the primary user on a day-to-day basis. Stated another way, such therapeutic chairs are not designed for users to use on a daily basis for several hours as a work chair for home or office use. Therapeutic chairs are specifically designed for limited use by therapy patients and not for continued daily use. On the contrary, chairs designed for such daily and/or prolonged use in the home or office should preferably provide support for body parts that may be potentially stressed over prolonged periods of sitting and efficient access and operation for single occupant-users.

Another drawback of adjustable therapeutic chairs is that they include arm, leg, and/or facial rest surfaces that obstruct the user's view or vocalization and therefore could not be functionally used with a desk in order to work, type on a keyboard, conduct telephone conversations or video conferences, view computer display screens, and the like.

Other types of adjustable chairs exist that allow a user to selectively adjust various chair members as desired by the user. However, these types of adjustable chairs do not provide fixed positioning of certain chair members, such as a seat and a chest support, in order to ensure that the user is seated in an optimally ergonomic position to properly support the user's spine. Advantageously, this would ensure proper spine support for the user, even if the user is ignorant as to the most optimal spine support sitting position.

Therefore, a need exists to overcome the problems with the prior art as discussed above.

SUMMARY OF THE INVENTION

The invention provides an adjustable seating assembly that overcomes the hereinafore-mentioned disadvantages of the heretofore-known devices and methods of this general type and that provides multiple seating positions for a user that relieves back and other body pain experience by the user.

With the foregoing and other objects in view, there is provided, in accordance with the invention, an adjustable seating assembly including a base having a first end, a second end opposite the first end, and a length extending from the first end to the second end; and a frame assembly having a pair of support legs coupled to the base along the length. The adjustable seating assembly further includes a seating-support surface with peripheral user-contact points surrounding the seating-support surface and defining a seating plane, the seating-support surface disposed above the base and coupled to the frame assembly; and a chest-support surface with peripheral user-contact points surrounding the chest-support surface and defining a chest plane, the chest-support surface disposed above the base, coupled to the frame assembly, and orientated, via the chest plane, at an acute angle with respect to the seating plane of the seating-support surface. Each of the pair of the support legs is selectively translatable along the length of the base in a first direction and a second direction, opposite the first direction, so as to selectively rotate the chest-support surface and the seating-support surface simultaneously while maintaining the acute angle between the chest plane and the seating plane during the selective rotation of the chest-support surface and the seating-support surface.

In accordance with another feature of the present invention, the base includes a slide structure along the length of the base, the slide structure centrally disposed below the seating-support surface and operably configured to allow each of the pair of support legs to selectively slide along the length of the base in the first direction and the second direction.

In accordance with another feature, an embodiment of the present invention includes a chin-support surface coupled to the chest-support surface, shaped to conform to a shape of a human chin, and operably configured to terminate between a user's eye area and the user's chin when the user's chin is supported thereon so as not to obstruct the user's vision or vocalization.

In accordance with another feature, an embodiment of the present invention includes a pair of arm rests, each of the pair of arm rests: disposed on opposing sides of the chest-support surface, extending substantially perpendicular to the chest-support surface, and having an uppermost arm-contacting surface disposed above a mid-point of a longitudinal length of the chest-support surface.

In accordance with a further feature of the present invention, each of the pair of the arm rests further includes a first end, a second end opposite the first end, and a length extending from the first end to the second end, the length providing a support surface sufficient to support and directly contact a substantial portion of the user's forearm as it is fully extended outwardly away from the chest-support surface in a substantially parallel orientation with respect to a ground surface.

In accordance with yet a further feature of the present invention, the chest-support surface and the seating-support surface are fixed with respect to one another at the acute angle.

In accordance with an additional feature of the present invention, the frame assembly includes a plurality of pivots, a first one of the plurality of pivots pivotally couples each of the pair of support legs to one another such that each of the pair of support legs is rotatable relative to the other of the pair of support legs.

In accordance with another feature of the present invention, a second one of the plurality of pivots is disposed at an end of a first of the pair of support legs that is coupled to the base along the length of the base, and a third of the plurality of pivots is disposed at an end of a second of the pair of support legs that is coupled to the base along the length of the base.

In accordance with yet another feature of the present invention, at least one of the pair of support legs extends upwardly above the seating-support surface and couples to the chest-support surface for supporting the chest-support surface thereon.

In accordance with yet another feature of the present invention, the acute angle is at most 80 degrees.

In accordance with another feature, an embodiment of the present invention includes a desk with a planar desktop surface at least partially defining a work area; and an adjustable seating assembly arranged toward the desk. The adjustable seating assembly may have a base having a first end, a second end opposite the first end, and a length extending from the first end to the second end; a frame assembly having a pair of support legs coupled to the base along the length; a seating support surface disposed above the base and coupled to the frame assembly; and a chest-support surface disposed above the base and coupled to the frame assembly. The chest-support surface may be orientated at an acute angle with respect to the seating-support surface and each of the pair of the support legs may be selectively translatable along the length of the base in a first direction and a second direction opposite the first direction so as to selectively rotate the chest-support surface and the seating-support surface simultaneously while maintaining the acute angle between the chest support surface and the seating-support surface during the rotation. The adjustable seating assembly may further include a pair of arm rests extending outwardly toward the desk, each of the pair of arm rests: disposed on opposing sides of the chest-support surface, extending substantially perpendicular to the chest-support surface, and having an uppermost arm-contacting surface disposed above a mid-point of a longitudinal length of the chest-support surface.

In accordance with a further feature of the present invention, the pair of arm rests are substantially parallel with the planar desktop surface.

In accordance with yet a further feature of the present invention, a distance between a desk-facing end of each of the pair of arm rests and an edge of the planar desktop surface is less than a length of a standard-sized hand such that the work area is accessible by a user's hand.

In accordance with another feature, an embodiment of the present invention includes an adjustable seating assembly having a base with a first end, a second end opposite the first end, and a longitudinal slide structure extending from the first end to the second end; and a frame assembly having a pair of support legs coupled to the base along a length of the base between the first end and the second end. The adjustable seating assembly may have a seating-support surface disposed above the base, centrally disposed above the longitudinal slide structure, and coupled to the frame assembly; and a chest-support surface disposed above the base and coupled to the frame assembly. The chest-support surface may also be orientated at an acute angle with respect to the seating-support surface and each of the pair of the support legs may be selectively translatable along the longitudinal slide structure in a first direction and a second direction opposite the first direction so as to selectively rotate the chest-support surface and the seating-support surface simultaneously while maintaining the acute angle between the chest-support surface and the seating-support surface during the rotation.

Although the invention is illustrated and described herein as embodied in an adjustable seating assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, unless otherwise indicated herein, the term "longitudinal" should be understood to mean in a direction corresponding to an elongated direction of the adjustable seating assembly spanning from the base toward the chest support surface.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
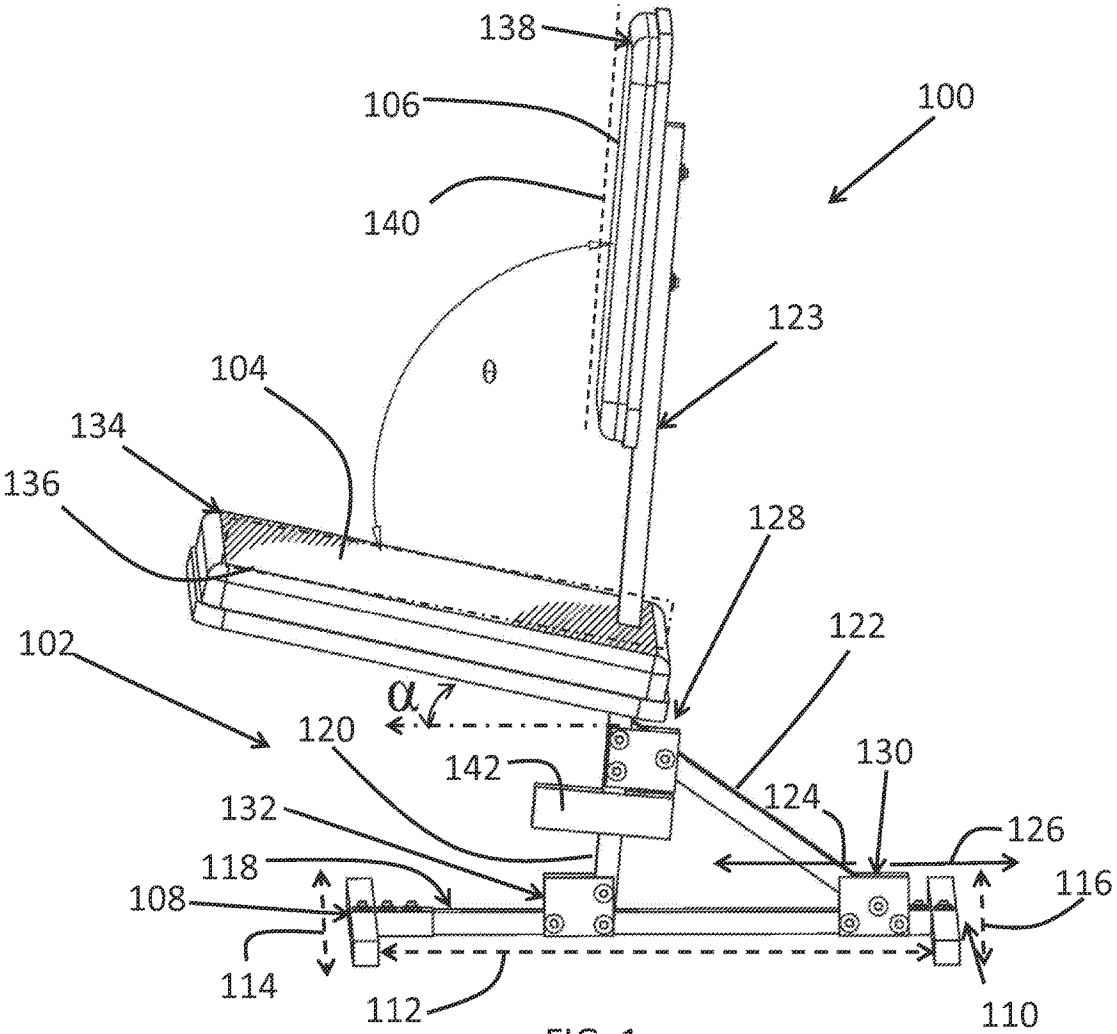
FIG. 1 is a perspective view of an adjustable seating assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient adjustable seating assembly. Embodiments of the invention provide an adjustable seating assembly with a chest-support surface orientated at an acute angle with respect to a seating-support surface to provide optimal spine support for an occupant of the adjustable seating assembly. In addition, embodiments of the invention provide a frame assembly with support legs that are translatable along the length of a base so as to selectively rotate the chest-support surface and the seating-support surface together, simultaneously, allowing the user to adjust the orientation of the seating area with respect to the ground surface for optimum user comfort. Further, embodiments of the present invention include a chin support and a pair of arm rests arranged toward a desk and configured to provide the user with arm support while working on the desk.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of an adjustable seating assembly 100, as shown in FIG. 1, includes a base 102 supporting the assembly 100 on a ground surface, a seating-support surface 104, and a chest-support surface 106.

Figure 3:
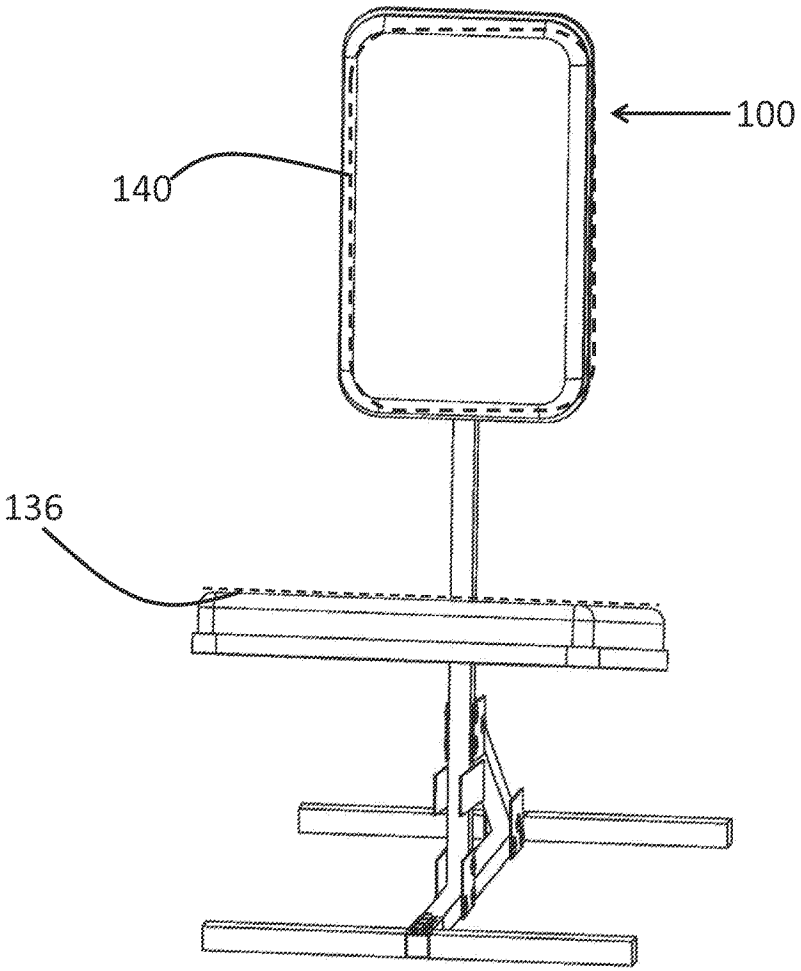
FIG. 3 is a front view of the adjustable seating assembly of FIG. 1, in accordance with the present invention.

The seating-support surface 104 and the chest-support surface 106 can be seen as defining a chest-supported seating area for a user. Specifically, the seating-support surface 104 may be described as having peripheral user-contact points, e.g., point 134, surrounding the seating-support surface 104 and defining a seating plane 136. Similarly, the chest-support surface 106 may also be described as having peripheral user-contact points, e.g., point 138, surrounding the chest-support surface 106 and defining a chest plane 140 (also shown in FIG. 3). The planes 136, 140 are, as the name implies, planar and are defined by those continuous or discontinuous points at or near (within +/−20% of the total surface area) the periphery of the surfaces 104, 106.

The seating-support surface 104 and the chest-support surface 106 may be made of the same or similar materials. In one embodiment, the seating-support surface 104 and/or the chest-support surface 106 may include a soft or semi-firm cushion therein to support the user thereon and provide user comfort. In another embodiment, the seating-support surface 104 and/or the chest-support surface 106 may be made of a polymer-based material. In other embodiments, the seating-support surface 104 and/or the chest-support surface 106 may be made of other types of materials known in the art for seats and other user-support members.

In one embodiment, the seating-support surface 104 and the chest-support surface 106 can be seen as disposed and oriented at an acute angle, theta, with respect to one another. Specifically, the surfaces 104, 106 can be described as being orientated, via the chest plane 140, at an acute angle with respect to the seating plane 136 of the seating-support surface 104, such that the desired and/or proper user configuration is increasingly effectuated throughout positioning of the device. In one embodiment, the acute angle, theta, is at most 80 degrees. In yet a further embodiment, the acute angle, theta, is between 65 degrees and 85 degrees. In yet another embodiment and unless otherwise indicated, the acute angle, theta, may be outside of these ranges. In one embodiment, the seating-support surface 104 and the chest-support surface 106 are fixed with respect to one another at the acute angle, theta. As used herein, the term "fixed" is intended to indicate a coupling of the seating-support surface 104 to the chest-support surface 106 that is securely fastened in a permanent manner such that the angular orientation with respect to one another remains the same throughout any selective adjustments of other elements of the adjustable seating assembly 100. In other words, "fixed" indicates a coupling that is difficult to uncouple without special tools or without damaging the assembly 100. Stated yet another way, "fixed" is intended to indicate the opposite of "selectively adjustable." In embodiments where the seating-support surface 104 and the chest-support surface 106 are fixed with respect to one another, one advantage is the provision of proper spine support and orientation for the user, even if the user is unaware of the most optimal spine support sitting position.

Figure 6:
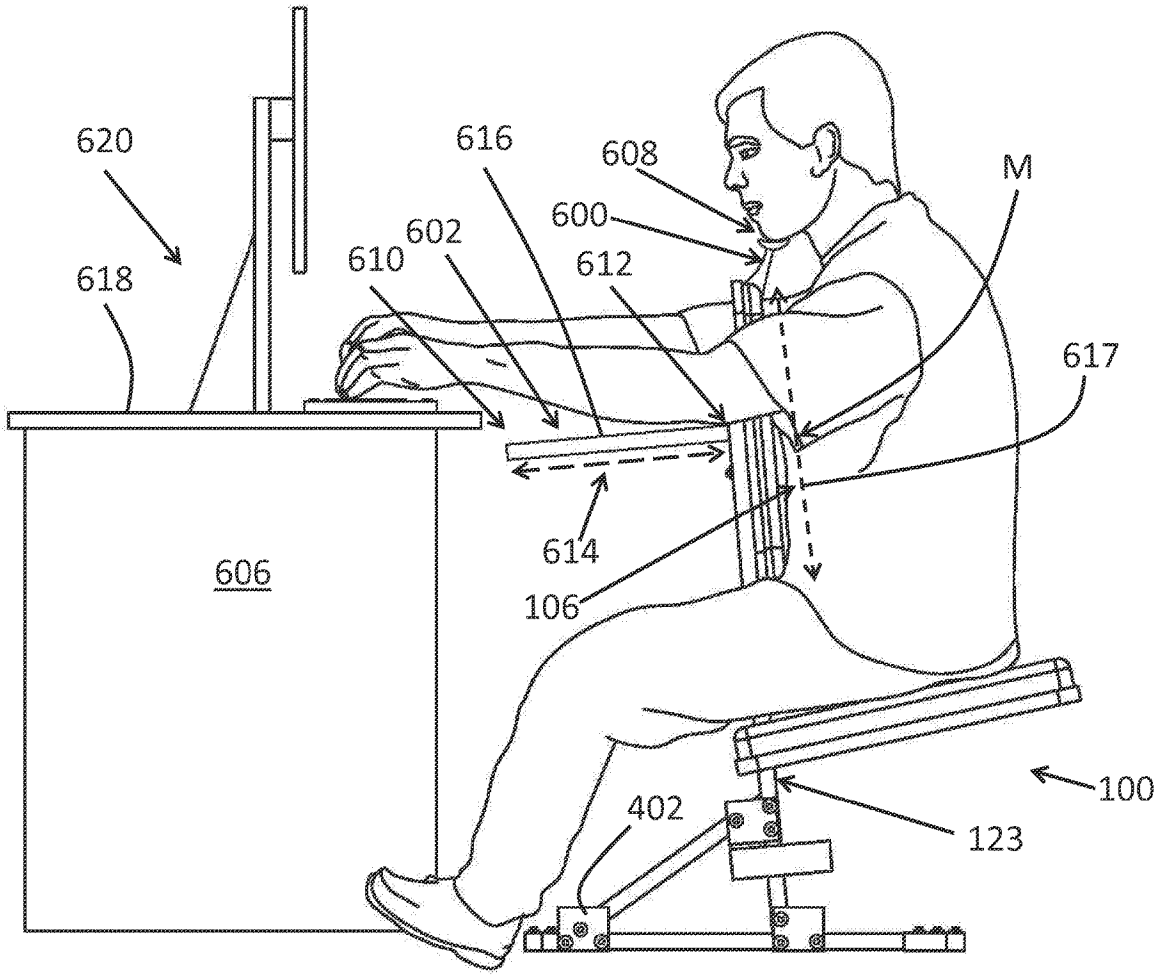
FIG. 6 is a perspective view of another embodiment of an adjustable seating assembly with a chin and arm rests in use by a user, in accordance with an exemplary embodiment of the present invention.

In one embodiment, it is the entire surface of each of the seating-support surface 104 and the chest-support surface 106 that is at an acute angle. In other embodiments, there may be portions of the surface of each of the seating-support surface 104 and the chest-support surface 106 that are not at an acute angle, but otherwise provide the user with a declining orientation with respect to the ground surface. Said another way, the user is oriented such that his or her weight is at least partially supported by the chest-support surface 106 when the assembly is in the operational position, as illustrated in FIG. 6, which shows the user leaning slightly forward onto the chest-support surface 106. This orientation provides the user with not only comfort (or the alleviation of pain), but also with a posture that facilitates the rehabilitation of back pain and other orthopedic medical conditions.

In one embodiment, the chest-support surface 106 can be seen as disposed substantially upright with respect to the ground surface. As used herein, "substantially upright" is intended to indicate an angular orientation with respect to the ground surface (when the adjustable seating assembly 100 is in its operational position supported on the ground surface) that is 90 degrees (+/−15 degrees). In other embodiments, based on the user's desired positioning, the chest-support surface 106 may be disposed at other angles outside of 90 degrees (+/−15 degrees). As used herein, during any discussion herein of angular orientations or other configurations of elements of the adjustable seating assembly 100 with respect to other elements thereof or the ground surface, it is understood that the discussion pertains to the adjustable seating assembly 100 in its operational configuration for use the a user and supported on a planar ground surface, unless otherwise indicated, such as when the discussion clearly pertains to a collapsible storage configuration of the adjustable seating assembly 100. The substantially upright position of the chest-support surface 106 is in contrast with therapeutic chairs, which are typically designed to support the user in a substantially forward position at an obtuse angular orientation of a chest and seat support with respect to one another. As used herein, "substantially forward" is intended to indicate an angular orientation of the chest-support surface 106 with respect to the ground surface that is at most 65 degrees.

In one embodiment, the seating-support surface 104 can be seen as disposed and oriented at an acute angle, alpha, with respect to the ground surface. In a further embodiment, the acute angle, alpha, is at most 25 degrees with respect to the ground surface. In yet a further embodiment, the acute angle, alpha, is at most 20 degrees with respect to the ground surface. In yet another embodiment and unless otherwise indicated, the acute angle, alpha, may be outside of these ranges.

Figure 7:
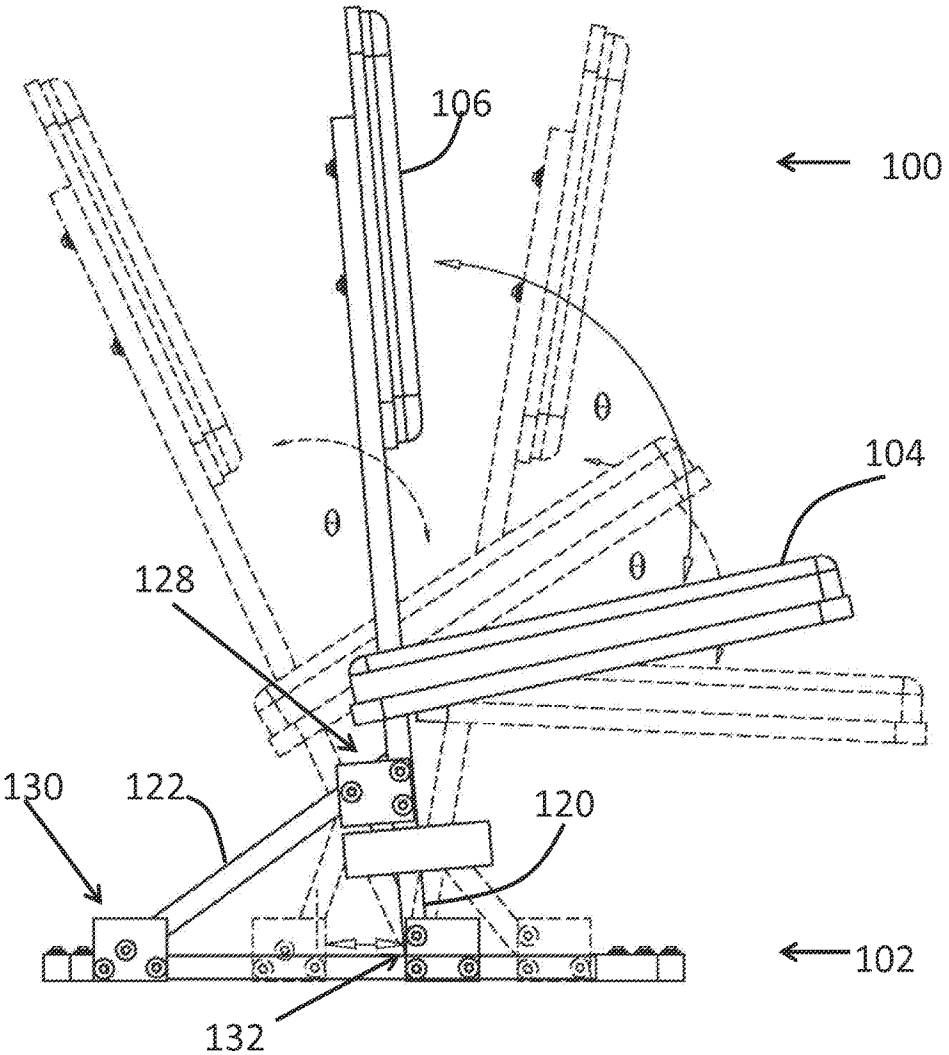
FIG. 7 is a side view of an adjustable seating assembly, showing alternate angular orientations of the seat and chest support, in accordance with the present invention.

An optimal angular orientation of the seating-support surface 104 and the chest-support surface 106 with respect to one another and/or with respect to the ground surface ensures optimal spine support and orientation for users, while also being free of any obstructions (e.g., donut face pillows) and being uniquely configured to allow such users to work at a desk area while sitting in the adjustable seating assembly 100. Importantly, when sitting in a regular office chair, the bottom of the pelvis is pushed forward and under, thereby eliminating the healthy "S-curve" of the normal spine and puts significant amounts of pressure on the lower spine. When sitting in the adjustable seating assembly 100 of the present invention, the pelvis can be pushed back, leaving the natural S-curve of the spine and eliminating the stress related to sitting in conventional office chairs for a prolonged period of time. Instead of a seat back, the adjustable seating assembly may have padding that includes the chest-support surface 106, or "seat front." When desired for use, the user sits on the seating-support surface 104 (or "seat"), which may also include padding, and leans forward, positioning his or her chest and/or stomach on the seat front. The angle of the seating-support surface 104 and the chest-support surface 106, and therefore the angle from the ground in which the user sits, can be adjusted to be "laying" forward to the most comfortable angle, as can be seen in FIG. 7 and which will be discussed in more detail herein below. This adjustment allows the user to find the ideal angle for his pelvis to be situated, to allow for the optimal S-curve of his spine. This angle also disperses the user's body weight, alleviating pressure that normally compresses the lumbar/lower back.

Figure 2:
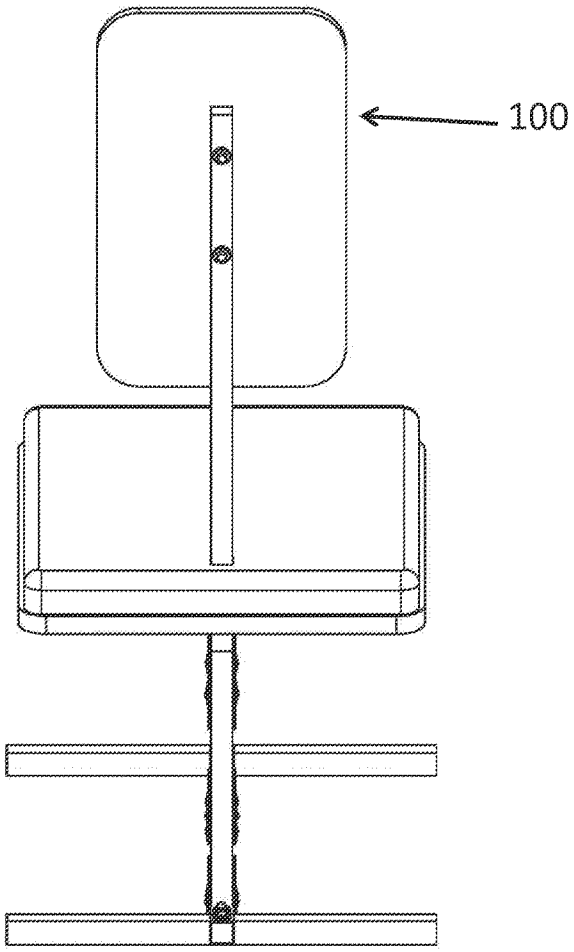
FIG. 2 is a rear view of the adjustable seating assembly of FIG. 1, in accordance with the present invention.

The base 102 provides a stable ground support for the elements of the seating assembly 100 above the base 102, as well as, the user seated thereon. Accordingly, the seating-support surface 104 and the chest-support surface 106 are disposed above the base 102. In one embodiment, the base 102 is operably configured to lay flat on the ground surface for stable support thereon. In another embodiment, the base may include castors for transportability. In one embodiment, the base 102 includes a first end 108 and a second end 110 opposite the first end 108. In a further embodiment, the base 102 includes a first length 112 extending from the first end 108 to the second end 110. In one embodiment, the first length 112 defines a longitudinal axis of the base 102 that also extends from the first end 108 to the second end 110 of the base 102. In a further embodiment, the base 102 may include a second length 114 and a third length 116 along respective transverse axes of the base 102, forming an "I"-shaped base 102. The second length 114 and third length 116 may be of equal dimensions and lengths, with the first length 112 being interposed there-between at a perpendicular orientation therewith. In a further embodiment, the first end 108 and the second end 110 of the length 112 are coupled to the second 114 and third lengths 116, respectively, at their mid-points for optimum ground support (see FIGS. 2-3 together with FIG. 1).

In one embodiment, the length 112 of the base 102 may be approximately 27" in length and may have approximately 18" cross-sectional "legs" 114, 116 in the front and back extending a width of the assembly 100. In one embodiment, the base 102 may be constructed of approximately 1⅛" square tube steel, and the surface of the seat or front seat may be made of approximately ½" plywood, a polymeric material, a metallic material or any other material providing durability and rigidity to resist the weight of the user. The above dimensions and materials are not limiting, however, as they may be modified in accordance with the invention disclosed herein. Casters may also be added to one or more portions of the assembly 100 for ease of transport.

In one embodiment, the base 102 includes a slide structure 118 that allows the seating-support surface 104 and the chest-support surface 106 to be selectively adjusted together with respect to the ground surface for optimum spine support by the user. The slide structure 118 may be disposed along the length 112 of the base 102. In a further embodiment, the slide structure is centrally disposed directly below a centerline of the seating-support surface 104. In one embodiment, the slide structure 118 is operably configured to allow a pair of support legs 120, 122 to selectively slide along the length 112 of the base 102 in a first direction 124 and a second direction 126, which is opposite the first direction 124, so as to allow the user to selectively adjust the seating-support surface 104 and the chest-support surface 106 together, simultaneously with respect to the ground surface. In another embodiment, this selective adjustability of the seating-support surface 104 and the chest-support surface 106 is implemented with other, non-slide-based, structures. For example, in one embodiment, the base 102 may include a track and/or a guide rail on which rolling wheels attached to the support legs 120, 122 allow the user to adjust the angular orientation of the seating-support surface 104 and the chest-support surface 106 with respect to the ground surface (see FIG. 7). In yet further embodiment, the selective adjustability of the seating-support surface 104 and the chest-support surface 106 may be implemented with other types of known structures and configurations.

The adjustable seating assembly 100 may include a frame assembly 123. The frame assembly 123 provides the structural support for the seating-support surface 104 and the chest-support surface 106, as well as, the functional support, along with the base 102, for the selective adjustability of the assembly 100. Accordingly, the base 102, the seating-support surface 104, and the chest-support surface 106 are coupled to the frame assembly 123. The frame assembly 123 may be made of rigid materials, such as metal, steel, or a rigid polymer-based material to provide rigid support for the adjustable seat assembly 100.

The frame assembly 123 may include the pair of support legs 120, 122 which are coupled to the base 102 along the length 112. Although the depicted embodiment includes a "pair" of support legs, it is contemplated that some embodiments may include more than two (2) support legs, or, alternatively, less than two (2) support legs. Still yet other embodiments may include frame support structures that are not considered "leg" supports, but may be formed as other shapes. As shown in FIG. 1, the device 100 can be seen having three pivots 128, 130, and 132, in which the legs 120, 122 are coupled. In one embodiment, the pivot 130 is fixed and the pivot 130 is translatable, linearly, along the base 102, independent of the pivot 132 in opposition directions 124, 126. In other embodiments, the pivot 132 and/or pivot 130 are translatable, linearly, along the base 102 to effectuate the desired rotation.

In one embodiment, each of the pair of support legs 120, 122 is selectively translatable along the base 102. More particularly, embodiments of the invention provide that each of the pair of support legs 120, 122 is selectively translatable linearly along the length 112 of the base 102 in the first direction 124 or the second opposing direction 126 so as to selectively rotate the chest-support surface 106 and the seating-support surface 104 together simultaneously while maintaining the acute angle, theta, between the chest-support surface 106 and the seating-support surface 104 during the entire rotation. In other words, the acute angle, theta, remains constant throughout the rotational movement to ensure proper spine support. To elaborate, the angle theta that is adjusted by this selective rotational movement is the angular orientation of the chest-support surface 106 and the seating-support surface 104 together, with respect to the ground surface in order to provide further comfort to the particular user. Further, in some embodiments, each of the pair of support legs 120, 122 can be considered independently translatable with respect to the base 102. In other embodiments, the seating-support surface 104 may be independently rotatable with respect to the chest-support surface 106 so as to further adjust the acute angle, theta.

In another embodiment, at least one of the support legs 120, 122 is longer than the other so as to extend upwardly above the seating-supporting surface 104 and couple to the chest-support surface 106, which is above the seating-supporting surface 104. In a further embodiment, the seating-supporting surface 104 defines a through-hole or opening, through which the longer of the support legs 120, 122 extends in order to contact and couple to the chest-support surface 106. The support leg 120 may be coupled to the chest-support surface 106 by any known fastener, such as, for example, screws, bolts, and the like.

In one embodiment, the frame assembly 123 includes a plurality of pivots providing for the advantageous adjustability that enables both the seating-support surface 104 and the chest-support surface 106 to rotate simultaneously. FIGS. 2-5 depict other views of the adjustable seat assembly 100, including close-up views of the pivots disposed on the assembly 100. In the exemplary embodiment, the frame assembly 123 includes three pivots 128, 130, and 132, each with one or two degrees of freedom. In other embodiments, the frame assembly 123 may include more than three (3) pivots, or, alternatively, less than three (3) pivots. In one embodiment, the first pivot 128 pivotally couples each of the pair of support legs 120, 122 to one another such that each of the pair of support legs 120, 122 is selectively rotatable relative to the other of the pair of support legs 120, 122. In a further embodiment, the support leg 122 includes a first end and a second end opposite the first end, with the first end pivotally coupled along a length of the support leg 120, at the first pivot 128, and the second end pivotally coupled to the base 102 along the length 112 of the base 102, at the second pivot 130. In yet a further embodiment, the support leg 120 includes a first end and a second end opposite the first end, with the first end coupled to the chest-support surface 106 and the second end pivotally coupled to the base 102 along the length 112 of the base 102, at the third pivot 132.

Figure 4:
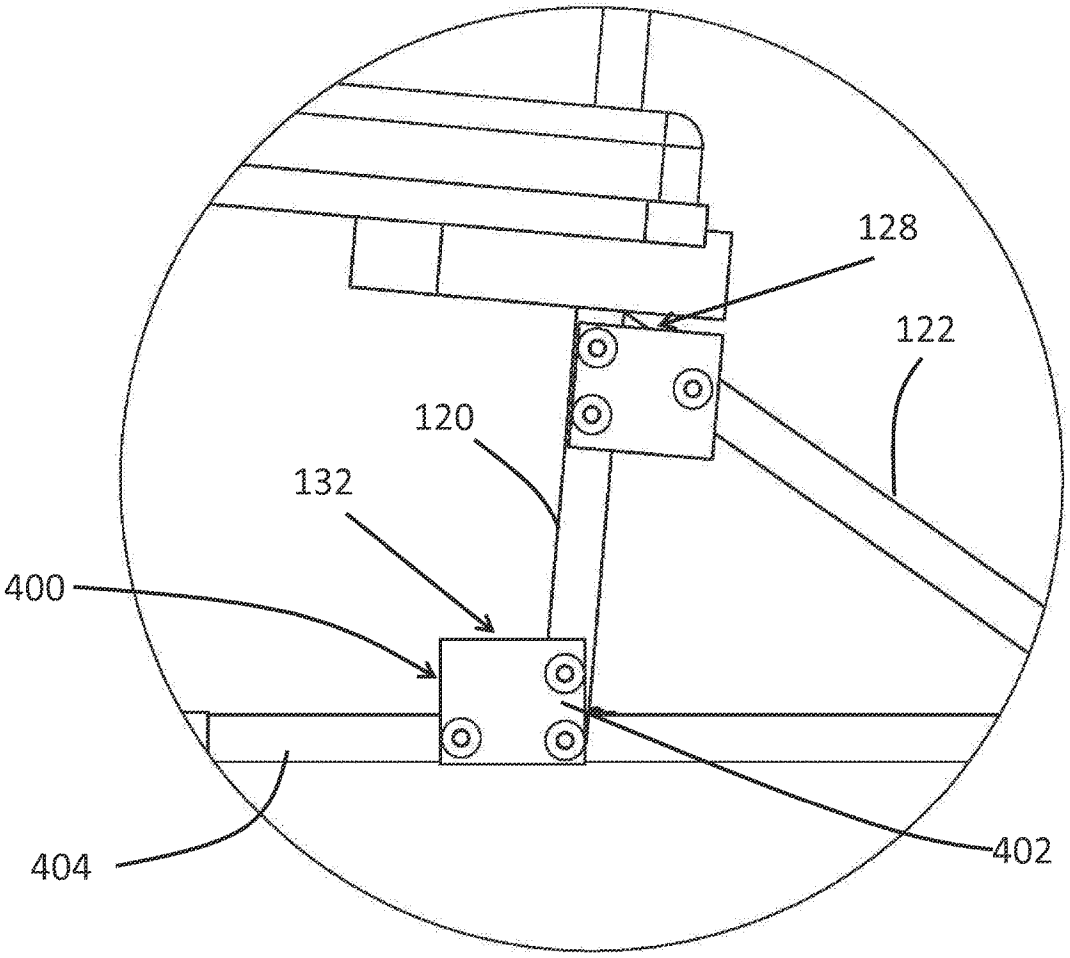
FIG. 4 is a fragmentary, enlarged view of adjustable legs of the frame assembly of the adjustable seating assembly of FIG. 1, in accordance with the present invention.
Figure 5:
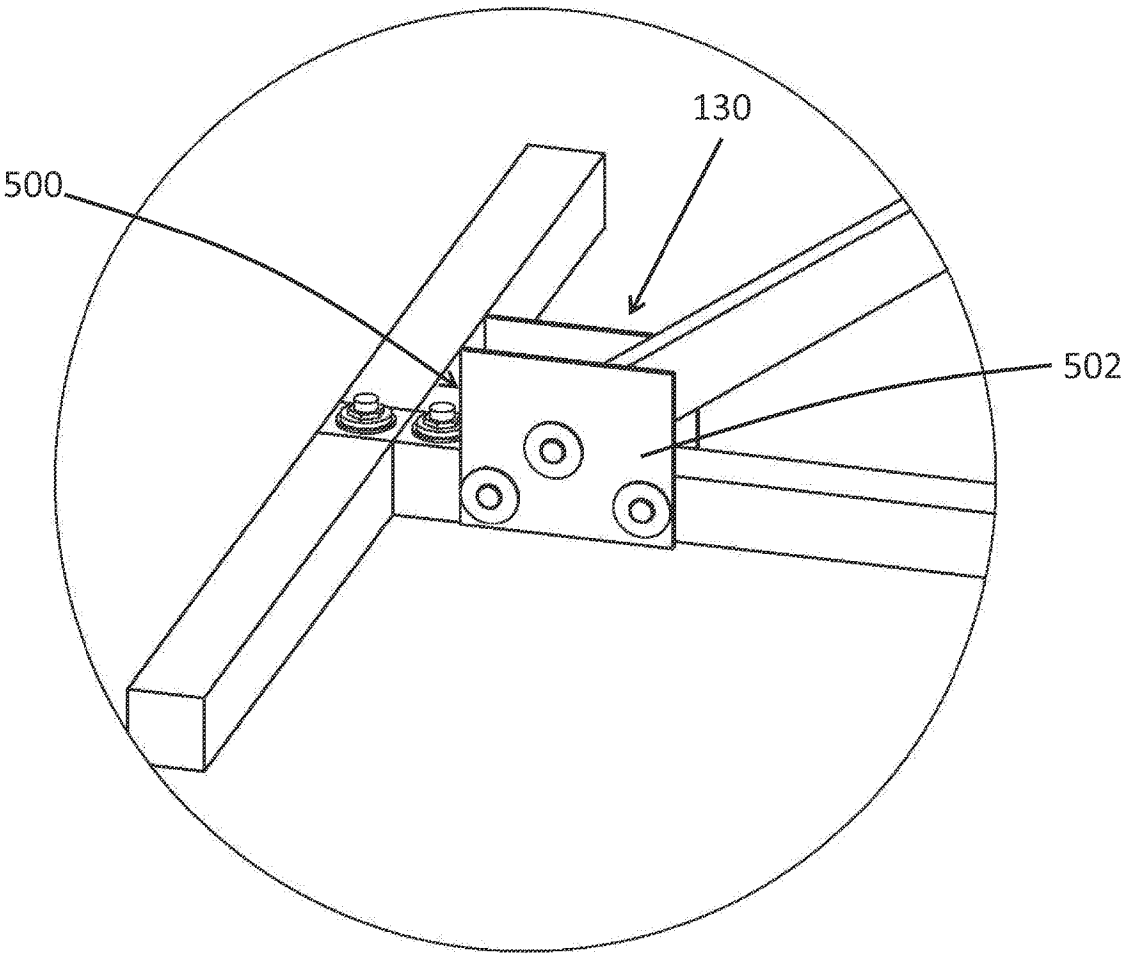
FIG. 5 is a fragmentary, enlarged view of an adjustable leg of the frame assembly of the adjustable seating assembly of FIG. 1, in accordance with the present invention.

Referring now briefly to FIGS. 4-5, together with FIG. 1, the pivots 128, 132 where the support legs 120, 122 couple to the base 102 are shown in enlarged perspective views. Also shown are guide members 400, 500, which may be included in some embodiments of the adjustable seating assembly 100. The guide members 400, 500 may be coupled to the base 102 and the respective support leg 120, 122 so as to effectuate translation along the length 112 of the base 102. The guide members 400, 500 include upright walls 402, 502 extending about a lower portion of the respective support leg 120, 122 so as to guide the linear movement of the support legs 120, 122 along the length 112 of the base 102. Alternatively, the linear movement of the support legs 120, 122 may be effectuated via a frame member, e.g., frame member 404, of the base 102. Accordingly, the support legs 120, 122 of the frame assembly 123 may be moved back-and-forth with respect to the base 102 and may be selectively locked into various locations along the base 102, while maintaining the angular orientation of the seating-support surface 104 and the chest-support surface 106. Said another way, the seating-support surface 104 and the chest-support surface 106 may be operably configured to rotate simultaneously with respect to the ground surface. In one embodiment, the support legs 120, 122 of the frame assembly 123 may be locked into place using a dowel pin. In other embodiments, a tongue-and-grove system or a notched-aperture tubing arrangement may be employed to selectively lock the support legs 120, 122 into position. When the locking mechanism and/or guide member 500 is disposed in front of the user (as best shown in FIG. 6), the user may advantageously manipulate or adjust the rotational positioning of the seating-support surface 104 and the chest-support surface 106 quickly and efficiently.

As shown in FIG. 7, the user may utilize the pivots 128, 130, and 132 and the linear translation of the support legs 120, 122 along the base 102 to select a desired orientation of the seating-supporting surface 104 and the chest-support surface 106 with respect to the ground surface. Once selected, the user may, in some embodiments, lock the support legs 120, 122, the seating-supporting surface 104, and the chest-support surface 106 into the selected orientation for use. Stated another way, the seating-support surface 104 and the chest-support surface 106 may be operable to be tilted forward and backward with respect to the ground surface to provide various positions for the user. In some embodiments, the seating-support surface 104 and the chest-support surface 106 may also be vertically adjusted with respect to the base 102 to accommodate the height of various users.

Figure 8:
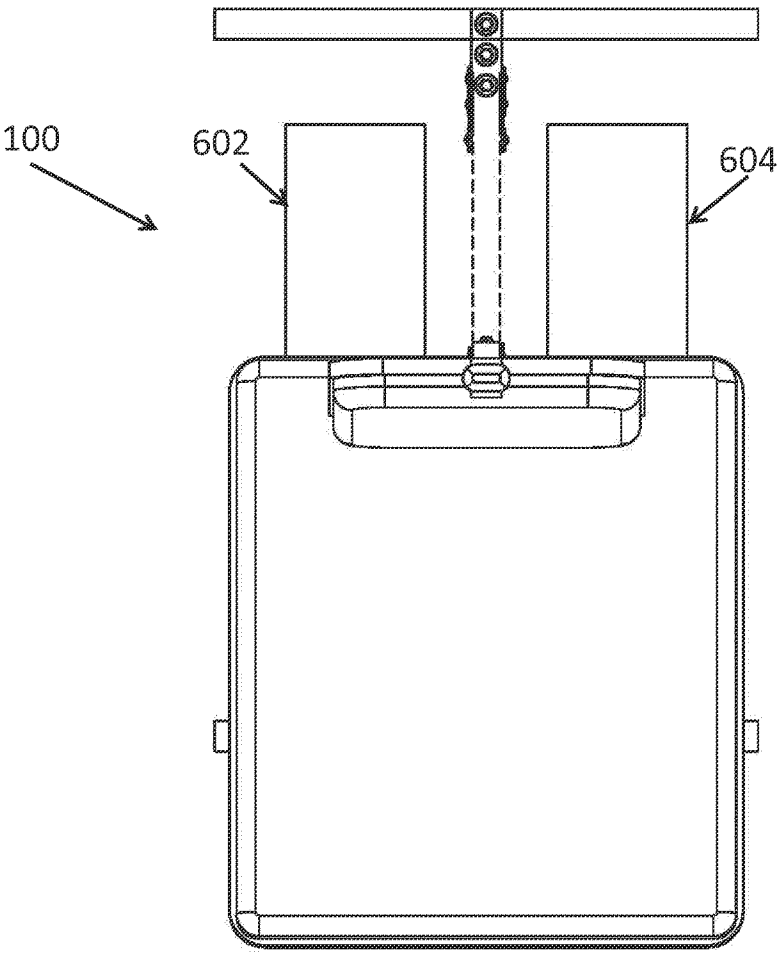
FIG. 8 is a plan view of the adjustable seating assembly of FIG. 6 in accordance with the present invention.

Referring now primarily to FIGS. 6 and 8 (with brief reference to FIG. 1), the adjustable seating assembly 100 is shown in a side view with a chin-support surface 600, a pair of arm rests 602, 604, and a desk 606.

The chin-support surface 600 may be shaped to conform to the shape of a human chin. In one embodiment, the chin-support surface 600 is formed as a curved body, such as a concave body. In one embodiment, the chin-support surface 600 defines a chin-receiving area 608 sized and shaped to receive the user's chin therein. In a further embodiment, the chin-receiving area 608 is sized to provide a friction fit with the user's chin so as to assist with retaining the chin therein. Accordingly, the chin-support surface 600 may include a cushion material for user comfort and/or be made of a resilient material to accommodate various sizes of the user's chin.

The chin-support surface 600 may be disposed above the chest-support surface 106 in order to support the user's chin. In one embodiment, the chin-support surface 600 is disposed directly above the chest-support surface 106. In another embodiment, the chin-support surface 600 is disposed a distance from the chest-support surface 106. The chin-support surface 600 may be slid into, fastened to, or otherwise coupled to, the top of the frame assembly 123 that supports the chest-supporting surface 106. The chin-support surface 600 may be removably coupled to the frame assembly 123, or, alternatively, may be integral with the frame assembly 123. Advantageously, the chin-support surface 600 provides a surface for the user to place, and support, his or her chin while working at the desk 606, without obstructing the user's vision. Said another way, the chin-support surface 600 does not have any material above the chin-support surface 600 that would otherwise hinder the eyesight of the user. The chin-support surface 600 can be seen as operably configured to terminate between the user's eye area and the user's chin when the user's chin is supported thereon so as not to obstruct the user's vision or vocalization toward the desk 606. As used herein, the term "terminate" is intended to indicate that no portion of the object extends beyond the stated boundary.

In one embodiment, the pair of arm rests 602, 604 are coupled to the chest-support surface 106. The pair of arm rests 602, 604 may be removably coupled to the chest-support surface 106, in one embodiment, or alternatively, integrally coupled with the chest-support surface 106, in another embodiment. The pair of arm rests 602, 604 may be disposed in the front area of the assembly 100 on opposing sides of the chest-support surface 106. Each of the pair of arm rests 602, 604 may have a first end 610, a second end 612 opposite the first end, and a length 614 extending from the first end 610 to the second end 612. In one embodiment, the length 614 may be at least a length of an average adult user's forearm. Advantageously, the length 614 provides a support surface sufficient to support and directly contact an entirety of the user's forearm as the user's forearm is fully extended out toward the desk's 606 work area in a substantially parallel orientation with respect to the ground surface. Therefore, the user's forearm may rest on the pair of arm rests 602, 604 during prolonged working hours. In another embodiment, the length 614 provides a support surface sufficient to support and directly contact a substantial portion of the user's forearm as the user's forearm is fully extended out toward the desk's 606 work area in a substantially parallel orientation with respect to the ground surface. As used herein, the term "substantial portion of the user's forearm" is intended to indicate at least 80% of the user's forearm. As used herein, the term "substantially parallel" is intended to indicate 0 degrees (+/−15 degrees). As used herein, the term "contact" is defined as touching. In one embodiment, the pair of arm rests 602, 604 extends substantially perpendicular to the chest-support surface 106. As used herein, the term "substantially perpendicular" is intended to indicate 90 degrees (+/−15 degrees).

In another embodiment, each of the pair of arm rests 602, 604 includes an uppermost arm-contacting surface 616 disposed above a mid-point, M, of a longitudinal length 617 of the chest-support surface 106. As used herein, the term "longitudinal length of the chest-support surface" is intended to indicate a length extending along an elongation direction of the chest-support surface.

The desk 606 and the arm rests 602, 604 provide the user the ability to have a relatively open work space and to rest his or her arms. In one embodiment, the desk 606 and the arm rests 602, 604 may include a substantially planar surface and may be rotatable from a working position substantially perpendicular (i.e., 90 degrees+/−15 degrees) to the chest-support surface 106 to a storing position that may be substantially parallel (+/−15 degrees) or, as depicted in FIG. 6, disposed in an acute angle with respect to the chest-support surface 106. The arm rests 602, 604 may be padded with a cushion material and are also preferably disposed at a location above the centroid or center of mass of the structure defining the chest-support surface 106 to provide comfort to the user. The arm rests 602, 604 may also be located and originate from other locations of the structure defining the chest-support surface 106.

In one embodiment, the desk 606 includes a planar desktop surface 618 at least partially defining a work area 620, the work area 620 also including the area directly above the planar desktop surface 618. The work area 620 may include a computer, a mouse, a keyboard, and the like thereon for the user to work. In one embodiment, at least one of the first and second ends 610, 612 of the pair of arm rests 602, 604 are also beginning edges of the planar desktop surface 618. In other words, the pair of arm rests 602, 604 may be integral with the desk 606 and/or may provide a support surface that is continuous with the planar desktop surface 618 on which the user may rest his or her forearms. In one embodiment, the pair of arm rests 602, 604 are considered substantially parallel with the planar desktop surface 618, or as depicted in FIG. 6, disposed in an acute angle with respect to the planar desktop surface 618. In one embodiment, the desk 606 and the adjustable seat assembly 100 are integral with one another, with the adjustable seat assembly 100 arranged towards the desk 606. In another embodiment, the desk 606 and the adjustable seat assembly 100 are removably coupled with one another. In yet another embodiment, the desk 606 and the adjustable seat assembly 100 are separate structures, but may be provided as a kit, sold as a system for use together, and/or sold separately for use together. In a further embodiment, a distance "d" between a desk-facing end of each of the pair of arm rests 602, 604 and an edge of the planar desktop surface 618 is less than a length of a standard-sized hand such that the work area 620 is accessible by the user's hand.

In alternative embodiments of the present invention, the assembly 100 also includes leg rests disposed underneath the seating-support surface 104. The bracket in which the leg rest may be coupled is schematically shown as element 142 in FIG. 1. Preferably, the leg rests extend in opposing directions and are coupled to the frame member supporting the seating-support surface 104 such that the leg rests translate when the seating-support surface 104 and chest-support surface 106 translate. The leg rests are advantageously placed such that the user can place his or her shin or anterior surface of the user's ankle while using the assembly 100. In another embodiment, the leg rests rotate outwardly, towards the front of the assembly 100 (i.e., in front of the leading edge of the seating-support surface 104), where they can be locked and the user can rest the posterior surface of the user's ankle.

An adjustable seating assembly has been disclosed that provides a novel and efficient adjustable seating assembly. Embodiments of the invention provide an adjustable seating assembly with a chest-support surface orientated at an acute angle with respect to a seating-support surface to provide optimal spine support for an occupant of the adjustable seating assembly. In addition, embodiments of the invention provide a frame assembly with support legs that are translatable along the length of a base so as to selectively rotate the chest-support surface and the seating-support surface together, simultaneously, allowing the user to adjust the orientation of the seating area with respect to the ground surface for optimum user comfort. Further, embodiments of the present invention include a chin support and a pair of arm rests arranged toward a desk and configured to provide the user with arm support while working on the desk.

What is claimed is:

1. An adjustable seating assembly comprising:

a base having a first end, a second end opposite the first end, and a length extending from the first end to the second end;

a frame assembly having a pair of support legs coupled to the base along the length;

a seating-support surface with peripheral user-contact points surrounding the seating-support surface and defining a seating plane, the seating-support surface disposed above the base and coupled to the frame assembly; and a chest-support surface with peripheral user-contact points surrounding the chest-support surface and defining a chest plane, the chest-support surface disposed above the base, coupled to the frame assembly, and orientated, via the chest plane, at an acute angle with respect to the seating plane of the seating-support surface, wherein each of the pair of the support legs selectively translatable along the length of the base in a first direction and a second direction, opposite the first direction, so as to selectively rotate the chest-support surface and the seating-support surface simultaneously while maintaining the acute angle between the chest plane and the seating plane during the selective rotation of the chest-support surface and the seating-support surface.

2. The adjustable seating assembly in accordance with claim 1, wherein:

the base includes a slide structure along the length of the base, the slide structure centrally disposed below the seating-support surface and operably configured to allow each of the pair of support legs to selectively slide along the length of the base in the first direction and the second direction.

3. The adjustable seating assembly in accordance with claim 1, further comprising:

a chin-support surface coupled to the chest-support surface, shaped to conform to a shape of a human chin, and operably configured to terminate between a user's eye area and the user's chin when the user's chin is supported thereon so as not to obstruct the user's vision or vocalization.

4. The adjustable seating assembly in accordance with claim 1, further comprising:

a pair of arm rests, each of the pair of arm rests:

disposed on opposing sides of the chest-support surface, extending substantially perpendicular to the chest-support surface, and having an uppermost arm-contacting surface disposed above a mid-point of a longitudinal length of the chest-support surface.

5. The adjustable seating assembly in accordance with claim 4, wherein:

each of the pair of the arm rests further includes a first end, a second end opposite the first end, and a length extending from the first end to the second end, the length providing a support surface sufficient to support and directly contact a substantial portion of the user's forearm as it is fully extended outwardly away from the chest-support surface in a substantially parallel orientation with respect to a ground surface.

6. The adjustable seating assembly in accordance with claim 1, wherein:

the chest-support surface and the seating-support surface are fixed with respect to one another at the acute angle.

7. The adjustable seating assembly in accordance with claim 1, wherein:

the frame assembly includes a plurality of pivots, a first one of the plurality of pivots pivotally couples each of the pair of support legs to one another such that each of the pair of support legs is rotatable relative to the other of the pair of support legs.

8. The adjustable seating assembly in accordance with claim 7, wherein:

a second one of the plurality of pivots is disposed at an end of a first of the pair of support legs that is coupled to the base along the length of the base, and a third of the plurality of pivots is disposed at an end of a second of the pair of support legs that is coupled to the base along the length of the base.

9. The adjustable seating assembly in accordance with claim 1, wherein:

at least one of the pair of support legs extends upwardly above the seating-support surface and couples to the chest-support surface for supporting the chest-support surface thereon.

10. The adjustable seating assembly in accordance with claim 1, wherein:

the acute angle is at most 80 degrees.

11. An adjustable seating system comprising:

a desk with a planar desktop surface at least partially defining a work area; and an adjustable seating assembly arranged toward the desk and having:

a base having a first end, a second end opposite the first end, and a length extending from the first end to the second end;

a frame assembly having a pair of support legs coupled to the base along the length;

a seating-support surface disposed above the base and coupled to the frame assembly;

a chest-support surface disposed above the base and coupled to the frame assembly, the chest-support surface orientated at an acute angle with respect to the seating-support surface and each of the pair of the support legs selectively translatable along the length of the base in a first direction and a second direction opposite the first direction so as to selectively rotate the chest-support surface and the seating-support surface simultaneously while maintaining the acute angle between the chest-support surface and the seating-support surface during the rotation; and a pair often rests extending outwardly toward the desk, each of the pair of arm rests:

disposed on opposing sides of the chest-support surface, extending substantially perpendicular to the chest-support surface, and having an uppermost arm-contacting surface disposed above a mid-point of a longitudinal length of the chest-support surface.

12. The adjustable seating system in accordance with claim 11, wherein:

the base includes a slide structure along the length of the base, the slide structure centrally disposed below the seating-support surface and operably configured to allow each of the pair of support legs to selectively slide along the length of the base in the first direction and the second direction.

13. The adjustable seating system in accordance with claim 11, further comprising:

a chin-support surface coupled to the chest-support surface, shaped to conform to a shape of a human chin, and operably configured to terminate between a user's eye area and the user's chin when the user's chin is supported thereon so as not to obstruct the user's vision of the desk's work area or vocalization towards the desk's work area.

14. The adjustable seating system in accordance with claim 11, wherein:

at least one of the pair of support legs extends upwardly above the seating-support surface and couples to the chest-support surface for supporting the chest-support surface thereon.

15. An adjustable seating assembly comprising:

a base having a first end, a second end opposite the first end, and a longitudinal slide structure extending from the first end to the second end;

a frame assembly having a pair of support legs coupled to the base along a length of the base between the first end and the second end;

a seating-support surface disposed above the base, centrally disposed above the longitudinal slide structure, and coupled to the frame assembly; and a chest-support surface disposed above the base and coupled to the frame assembly, the chest-support surface orientated at an acute angle with respect to the seating-support surface and each of the pair of the support legs selectively translatable along the longitudinal slide structure in a first direction and a second direction opposite the first direction so as to selectively rotate the chest-support surface and the seating-support surface simultaneously while maintaining the acute angle between the chest-support surface and the seating-support surface during the rotation.

16. The adjustable seating assembly in accordance with claim 15, further comprising:

a pair of arm rests, each of the pair of arm rests:

disposed on opposing sides of the chest-support surface, extending substantially perpendicular to the chest-support surface, and having an uppermost arm-contacting surface disposed above a mid-point of a longitudinal length of the chest-support surface.

17. The adjustable seating assembly in accordance with claim 15, wherein:

the chest-support surface and the seating-support surface are fixed with respect to one another at the acute angle.

18. The adjustable seating assembly in accordance with claim 15, further comprising:

a chin-support surface coupled to the chest-support surface, shaped to conform to a shape of a human chin, and operably configured to terminate between a user's eye area and the user's chin when the user's chin is supported thereon so as not to obstruct the user's vision or vocalization.

* * * * *